United States Patent [19]

Green

[11] Patent Number: 4,991,831

[45] Date of Patent: Feb. 12, 1991

[54] PAPER SHEET FEEDING APPARATUS

[76] Inventor: Ronald J. Green, E11412B N. Reedsburg Rd., Baraboo, Wis. 53913

[21] Appl. No.: 393,135

[22] Filed: Aug. 14, 1989

[51] Int. Cl.[5] ..... B65H 3/52; B65H 7/04; B65H 7/14

[52] U.S. Cl. ..... 271/121; 271/110; 271/125; 271/171

[58] Field of Search ..... 271/35, 110, 121, 124, 271/125, 165, 167, 171, 258

[56] References Cited

U.S. PATENT DOCUMENTS

| | | | |
|---|---|---|---|
| 3,372,923 | 3/1968 | Watson et al. | 271/23 |
| 3,425,685 | 2/1969 | Liva | 271/21 |
| 3,612,511 | 10/1971 | Godlewski | 271/110 |
| 3,748,937 | 7/1973 | Long | 83/12 |
| 3,831,928 | 8/1974 | Davis | 271/167 |
| 3,908,983 | 9/1975 | Long | 271/35 |
| 3,933,350 | 1/1976 | Mignano | 271/125 |
| 3,991,998 | 11/1976 | Banz et al. | 271/125 |
| 4,050,690 | 9/1977 | Michelson | 271/125 |
| 4,083,555 | 4/1978 | Irvine et al. | 271/125 |
| 4,437,658 | 3/1984 | Olson | 271/125 |
| 4,462,586 | 7/1984 | Browne et al. | 271/94 |
| 4,557,472 | 12/1985 | Hannon | 271/165 |
| 4,560,158 | 12/1985 | Wilson | 271/165 |
| 4,606,535 | 8/1986 | Larson | 271/10 |
| 4,607,832 | 8/1986 | Abe | 271/10 |
| 4,715,593 | 12/1987 | Godlewski | 271/10 |

FOREIGN PATENT DOCUMENTS

| | | | |
|---|---|---|---|
| 2627763 | 9/1989 | France | 271/125 |
| 258330 | 10/1988 | Japan | 271/125 |

*Primary Examiner*—H. Grant Skaggs
*Assistant Examiner*—Steven M. Reiss
*Attorney, Agent, or Firm*—Bell, Seltzer, Park & Gibson

[57] ABSTRACT

Disclosed is a sheet feeder device including support for a generally vertical stack of sheets. The support means includes endless belts having an upper belt run position to extend across the bottom of the stack of sheets. A stationary gate forming member is provided which is positioned above the upper run of the belts and adjacent the forward side of the stack to define a nip which forms a gap between the gate forming member and the upper run for permitting the lowermost sheet of the stack to pass forwardly from the stack through a nip. The gate forming member is a cylindrical roll defining a central axis and an outer peripheral surface which is concentric to the central axis. The roll has a plurality of annular grooves extending about the circumference thereof, and the grooves are disposed concentrically about a second axis which is eccentric to the central axis. An elastomeric ring is disposed in each of the grooves, and the rings have a coefficient of friction which is higher than that of the material of the roll.

30 Claims, 3 Drawing Sheets

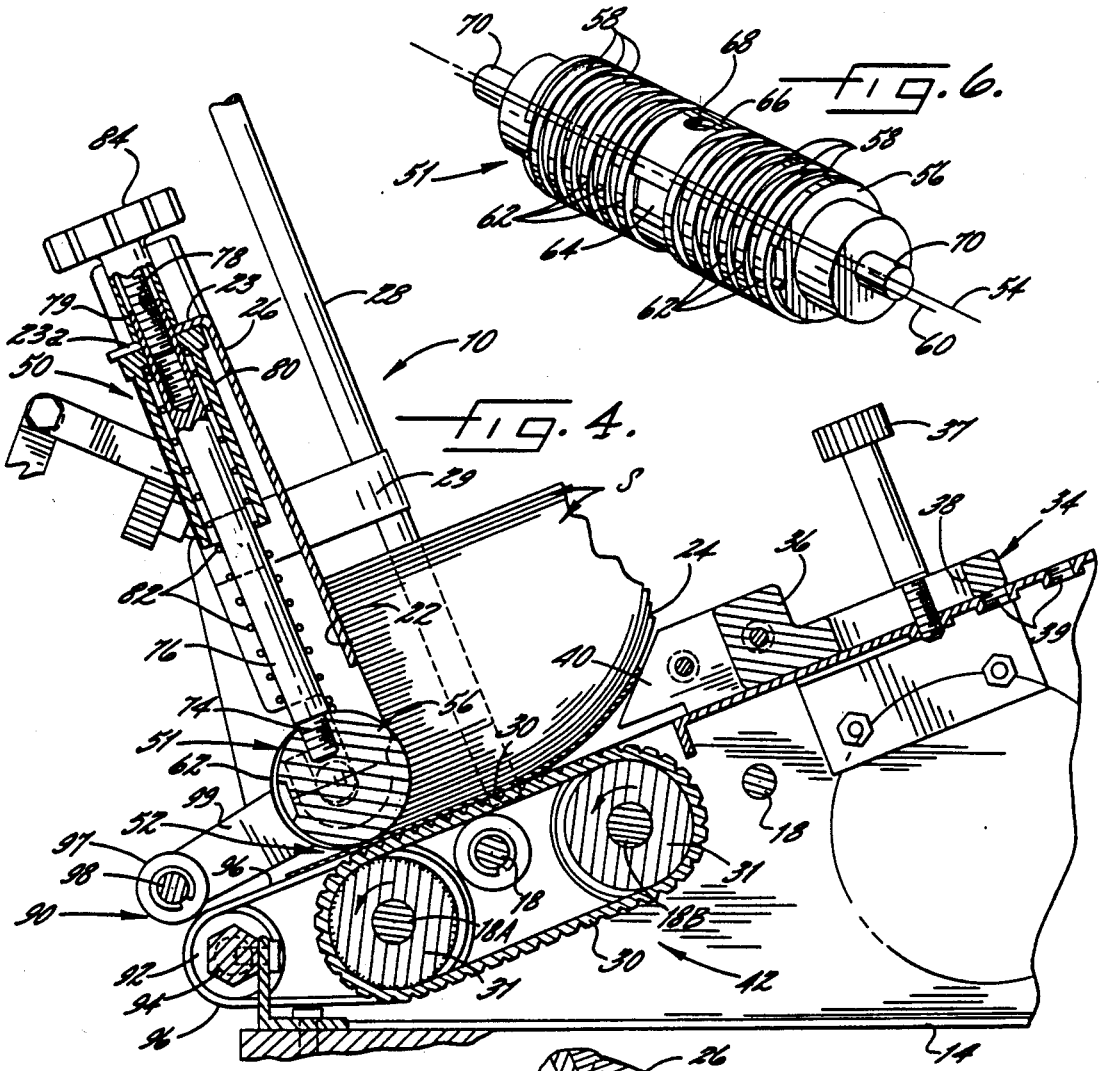
Fig. 6.
Fig. 4.
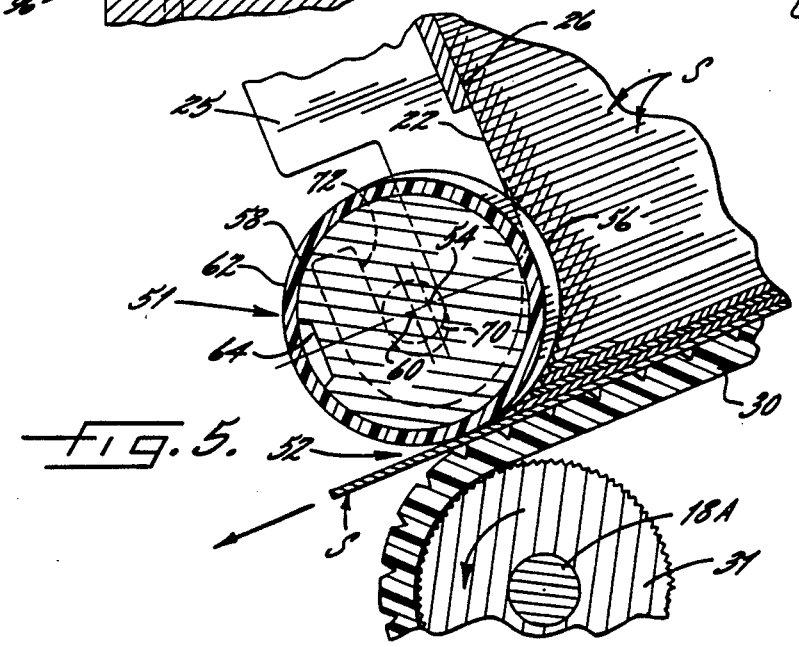
Fig. 5.

PAPER SHEET FEEDING APPARATUS

FIELD OF THE INVENTION

This invention generally relates to paper feeding apparatus and, more particularly, to an apparatus for serially feeding flat sheets of paper from the bottom of a vertical stack of such sheets and so on to permit subsequent processing of each individual sheet.

BACKGROUND OF THE INVENTION

Generally, sheet feeding devices capable of high speed feeding are relatively complicated, and require a large number of complex and interrelated moving parts which are subject to wearing out and failure.

Most known sheet feeders cannot dispense sheets in a shingled manner, but rather, only one sheet at a time. The ability to shingle sheets would greatly increase the efficiency of any feeder device, however, most feeder devices lack this ability. Also, most friction feed devices have problems feeding coated and slick stacks.

Prior sheet feeder devices use suction cups to engage the bottom of the sheet being fed. The suction cups then pull the sheet downward and a separator member holds the sheet downward by inserting itself between the stack of sheets and the suctioned sheet. Then, a gripper arm member pulls the suctioned piece out and drops the sheet onto a conveyor belt for individual processing. The use of the suction cup presents numerous problems for different applications. For example, if the sheet being fed is a folded sheet of paper, the suction cup can adhere only to the lower portion of the folded paper. Consequently, the separator member does not separate between two separate sheets in the stack but rather between different folds of the same sheet.

Another problem with the suction cup method is that it is unable to adequately perform when the sheets are made of a stiff material rather than a flexible material since the suction is not strong enough to bend the sheet.

Yet another problem with prior sheet feeder devices is the wearing out of parts of the device. In devices with a stationary top roller, this top roller often wore out and was expensive and inconvenient to replace.

SUMMARY OF THE INVENTION

It is an object of the present invention to provide for a reliable and efficient sheet feeding apparatus of the described type.

Another object of the present invention is to provide a sheet feeding apparatus capable of handling different types and sizes of paper sheets, including coated and slick sheets.

It is yet another object of the present invention to provide a sheet feeding apparatus which can shingle feed the sheets.

These and other objects and advantages of the present invention are achieved by the provision of an apparatus which comprises means for supporting a generally vertical stack of sheets so that the stack defines a forward side composed of aligned forward edges of the sheets and a bottom. The supporting means include endless belt means and means for mounting the endless belt means so as to have an upper belt run positioned to extend across the bottom of the stack of sheets. The apparatus also includes driving means for rotating the endless belt means so that the upper run moves in the forward direction. A stationary gate forming member is provided which is positioned above the upper run of the belt means and adjacent the forward side of the stack thereby defining a nip which forms a gap between the gate forming member and the upper run for permitting the lowermost sheet of the stack to pass forwardly from the stack through the nip. The gate forming member includes a first surface means which faces towards the forward side of the stack so as to engage the forward edges of the sheets in the stack, and second surface means at the nip and having a coefficient of friction which is higher than that of the first surface means. By design, the gap at the nip is dimensioned such that the lowermost sheet is free to pass through the nip without significant frictional resistance, while the sheet immediately above the lowermost sheet is retarded by its frictional engagement with the second surface means at the nip.

The gate forming member is preferably a cylindrical roll defining a central axis and an outer peripheral surface which is concentric to the central axis. The roll has a plurality of annular grooves extending about the circumference thereof, and the grooves are disposed concentrically about a second axis which is parallel to and offset from the central axis in a direction parallel to the forward feed direction and so that each groove is relatively deep along a first half of the peripheral surface of the roller facing the stack of sheets and relatively shallow along the opposite half of the peripheral surface. The transition between the first and second halves is located at the nip and at a diametrically opposite location.

The cylinder has rings disposed in each of the grooves. The rings have a higher coefficient of friction than the material of the roll and are sized so as to lie radially inside of the peripheral surface of the roll about the first half thereof and to extend radially beyond the peripheral surface about the second half thereof. This structure will allow the rings to extend slightly beyond the peripheral surface at the nip.

In one preferred mode of operation, the gap formed by the nip is adjusted to allow the lowermost sheet to freely pass therethrough, and so that the sheet above the lowermost sheet frictionally engages the rings at the nip and is retarded thereby. When the lowermost sheet has been fed forwardly a sufficient distance to permit the overlying sheet to contact the endless belt means, the overlying sheet is then driven forwardly into the nip to form a tight fit, and which in turn causes the sheets to be shingled as they are fed from the stack.

The sheet feeder device of the present invention may also include one or more guide means for ensuring that the sheet being fed is guided to its correct position on a conveyor belt or the like. The device may also include a photocell for sensing when a sheet is not in the process of being fed and then signaling the drive means to start the belt running so as to feed additional sheets.

BRIEF DESCRIPTION OF THE DRAWINGS

Some of the objects and advantages of the present invention having been stated, others will appear as the description proceeds, when taken in conjunction with the accompanying drawings in which:

FIG. 4 is a fragmentary side sectional view of the apparatus and taken along line 4—4 of FIG. 2.

FIG. 5 is an enlarged view of a portion of FIG. 4.

FIG. 6 is a perspective detailed view of the gate forming member of the apparatus.

DETAILED DESCRIPTION OF THE PREFERRED EMBODIMENT

Figure 1:
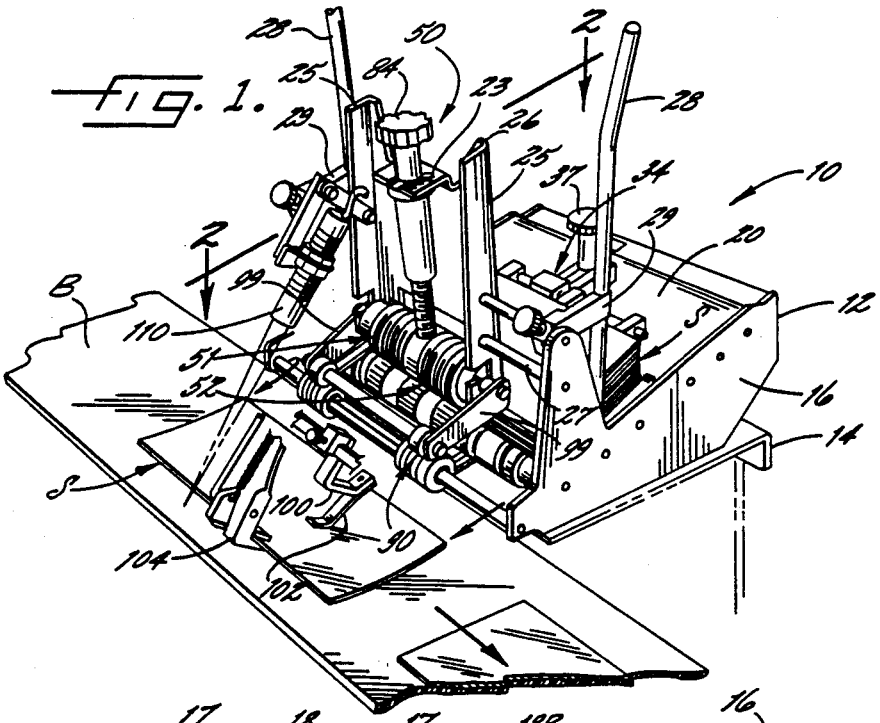
FIG. 1 is a perspective view of a sheet feeding apparatus which embodies the features of the present invention.

Referring more particularly to the drawings, an apparatus for serially feeding sheets of paper from a bottom of a generally vertically stack of such sheets, and which embodies the features of the present invention, is indicated generally at 10. The apparatus 10 is shown in use as a part of a sheet feeding system, and wherein the sheets S are fed laterally from the bottom of the stack onto a moving conveyor belt B, and so that the sheets may be subsequently collated with other sheets, or placed in mailing envelopes, in a conventional manner.

The apparatus 10 comprises a rigid frame 12 which includes a base plate 14, a pair of upright side plates 16 which are joined to the base plate, and a number of transverse rods 18 extending between and interconnecting the side plates. The transverse rods 18A and 18B are mounted by means of bearings 17 to the side walls, note FIG. 2, so as to permit the free rotation thereof. The remaining transverse rods are fixedly mounted to the side walls. Also, the frame includes a rear cover plate 20 which extends between the side plates 16 and is connected thereto at the rear portion of the frame.

Figure 3:
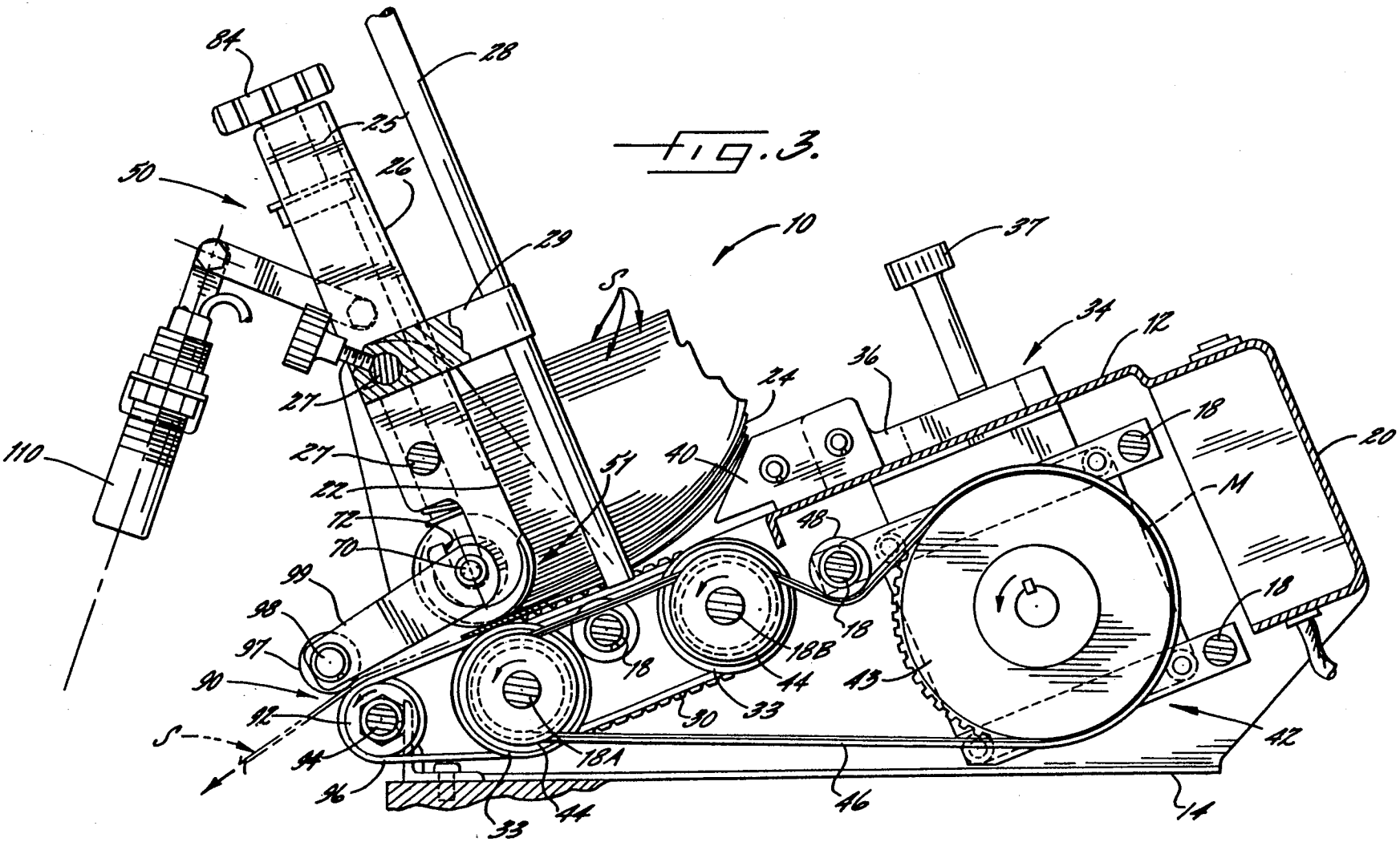
FIG. 3 is a side sectional view of the apparatus taken along line 3—3 of FIG. 2.

The apparatus 10 further comprises means for supporting a generally vertical stack of rectangular sheets 5 of paper. As best seen in FIG. 3, the supported stack defines a forward side 22 composed of aligned forward edges of the sheets, as well as the opposite rear side 24 composed of the aligned rearward edges of the sheets. The forward side of the stack is supported in the forward direction by a generally vertically extending front support plate 26. The front support plate includes inturned opposite sides 25, which are fixedly secured to the frame by transverse rods 27. The upper portion of the support plate includes a generally horizontal mounting bracket 23 having a forwardly extending slot **23*a*** for the purposes described below.

The means for supporting the vertical stack of paper sheets also includes a pair of vertical rods 28 which support respective opposite ends of the stack, and the rods are each mounted to the frame by an arm 29 which is fixed to the associated vertical rod, and which is coupled to a transverse rod 27 by an opening which receives the transverse rod, and a threaded member, so as to permit the separation of the rods 28 to be laterally adjusted. Thus the rods are able to accommodate stacks of sheets of different length therebetween.

The stack supporting means further includes endless belt means, and which comprises, in the illustrated embodiment, three endless belts 30, and a pair of aligned support rolls 31 (FIG. 4) mounted on respective ones of said support shafts 18A, 18B for mounting each of said endless belts. A plurality of drive rolls 33 are mounted on each of said support shafts 18A, 18B, with one of said drive rolls being positioned on each shaft between adjacent endless belts. The diameter of the support rolls 31 is less than the diameter of the drive rolls 33 so that said drive rolls have an outer surface which is substantially coextensive with the outer surface of said endless belts. The support rolls 31 are positioned such that the three belts 30 define coplanar upper runs which extend across the bottom of the stack. The belts 30 bridge the space between the drive rollers 33, and the belts 30 and drive rollers 33 serve to convey the sheets forwardly to the nip area in the manner further described below.

The stack supporting means also includes a rear support member 34 which is positioned above the upper runs of the three belts and below the rear side of the stack of sheets. The rear support member includes a bracket 36 which is releasably connected to the rear cover plate 20 by means of a threaded member 37 which extends through a slot 38 in the bracket and which threadedly engages a selected one of three threaded openings 39 in the rear cover plate. The bracket also includes four forwardly extending fingers 40 which underlie the rear side of the stack of sheets. The fingers each have an inclined forward edge as best seen in FIGS. 3 and 4, so as to lift the rear side of the stack upwardly from the upper run of the three belts. The lateral position of the bracket and the fingers is thereby adjustable so as to permit accommodation of sheets of differing widths.

The three belts 30 and drive rollers 33 are rotated by a drive system 42 so that the upper runs move in a right to left (or forward) direction as seen for example in FIG. 4. This drive system includes an electric motor M which is mounted to the frame of the apparatus beneath the rear cover plate, and which includes an output drive pulley 43. The drive system further includes drive pulleys 44 fixedly mounted on each of the two transverse rods 18A and 18B, and an endless drive belt 46 entrained about the three drive pulleys. Also, a follower pulley 48 is provided which engages the belt at a location between the pulleys 43 and 44 to ensure proper and firm engagement therewith.

The apparatus 10 further includes a stationary gate forming member 50 positioned above the upper runs of the three belts, and adjacent the forward side of the stack of sheets, and so as to define a nip 52 between the gate forming member 50 and the upper runs of the belts 30 and the forward drive rollers 33 on the rod 18A. In the illustrated embodiment, the gate forming member comprises a generally cylindrical roll 51 defining a central axis 54 and an outer peripheral surface 56 which is concentric to the central axis. Also, the roll 51 has a plurality of annular grooves 58 extending about the circumference thereof, with the grooves being disposed about a second axis 60 which is parallel to and offset from the central axis in a direction parallel to the forward direction. Thus the grooves are relatively deep along a first half of the peripheral surface of the roll, and relatively shallow along a second half of the peripheral surface.

As mounted on the apparatus, the peripheral half having the relatively deep groove portions faces rearwardly toward the stack of sheets, and the peripheral half having the relatively shallow groove portions faces forwardly. Also, a transition between the first and second halves is located adjacent the nip 52, and the other transition is located diametrically opposite the nip. The roll 51 further includes a ring 62 disposed in each of the grooves, with the rings being composed of a material having a higher coefficient of friction than that of the material of the roll. Also, the rings are sized so as to lie radially inside of the peripheral surface of the roll about the rearwardly facing half thereof, and to extend radially beyond the peripheral surface about the forwardly facing half thereof. As best seen in FIG. 5, and following the periphery of the roll and rings in a clockwise direction, it will be seen that the rings initially extend slightly beyond the peripheral surface 56 at the nip, and along the half of the periphery facing away from the stack they extend beyond the peripheral surface of the roll. At the location diametrically opposite the nip, the rings recede within the periphery of the roll, and they stay within the periphery of the roll along the rearwardly facing half of the periphery.

In a preferred embodiment, the roll is formed of an acetal or metallic material having a coefficient of friction of about 0.15–0.35 and the rings are formed of are an elastomeric material having a coefficient of friction of about 0.5–0.7. As those skilled in the art are aware, other materials for the roll and rings may also be used. Also, as best seen in FIG. 6, the roll includes an axially extending channel 64 in the forwardly facing half of the peripheral surface, which facilitates engagement of the rings and removal or rotational adjustment thereof.

The apparatus includes means for mounting the roll 51 so as to permit the dimension of the nip 52 between the roll and endless belts 30 and rollers 33 to be adjusted. The ability to adjust the nip allows for the single feeding of various thicknesses of sheets. More particularly, the roll includes a central portion 66 which does not include the grooves and rings, and a threaded radial opening 68 which extends into the central portion, note FIG. 6. Also, the opposite ends of the roll include coaxial mounting posts 70, which are received within respective ones of the vertically extending slots 72 in the sides 25 of the front support plate 26. A threaded rod 74 is threadedly received in the opening 68, and the threaded rod includes an upper portion 76 which extends through the slot 23*a* in the mounting bracket 23. This upper end portion is formed with an internally threaded axial bore 78, and a sleeve 80 and a spring 82 coaxially surround the rod below the mounting bracket 23, with the sleeve having an upper end which engages the underside of the bracket 23. The spring is under compression, so as to bias the roll 51 downwardly with respect to the bracket. This downward movement is limited by a control knob 84 which has a threaded member engaged in the bore 78 at the upper portion of the rod, and an outer concentric sleeve 79 for engaging the upper side of the mounting bracket. Thus rotation of the control knob tends to raise or lower the roll with respect to the bracket, and to thus change the vertical dimension of the gap at the nip 52 formed between the roll 51 and the endless belts 30 and rollers 33. Also, the spring will be seen to bias the roll toward the nip and it permits limited upward movement of the roll away from the nip and against the force of the spring.

The above-described mounting means for the roll 51 also permits the quick release and removal of the roll assembly which includes the roll 51, rod 74, sleeve 80, and control knob 84, to thereby facilitate replacement or rotational adjustment of the rings 62 as described above. More particularly, the assembly may be released and removed by lifting the roll 51 so that the mounting parts 70 are removed from the slots 72 in the sides 25 of the plate 26, and then slipped forward from the slot 23*a*.

Figure 2:
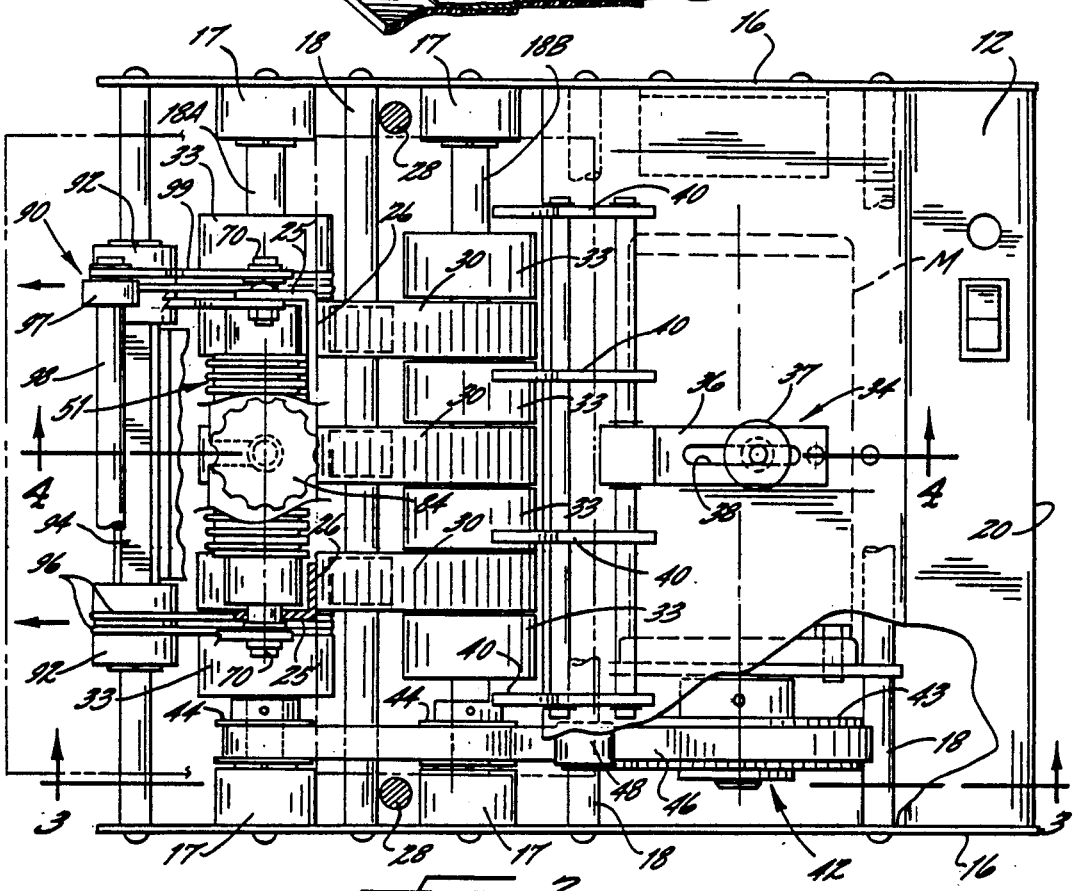
FIG. 2 is a top plan view of the apparatus as viewed along the line 2—2 in FIG. 1.

The apparatus further comprises sheet guide means 90 positioned downstream of and in registry with the nip for guiding the sheets forwardly after advancing through the nip. This sheet guide means, as seen in FIG. 2–4 comprises two laterally spaced apart guide roller segments 92 which are mounted for rotation about the transverse rod 94, which is disposed parallel to the axes of the rods 18A and 18B. The upper portions of the guide roller segments are substantially coplanar with the upper run of the three endless belts 30, and a transmission is provided for operatively connecting the drive motor with the guide roller segments, so that the guide roller segments rotate at a peripheral speed corresponding to the speed of the three endless belts 30 and rollers 33. This transmission comprises a pair of guide belts 96 entrained about each support roll segment and the adjacent roller 33 with the guide belts having an upper run which is substantially coplanar with the upper runs of the three endless belts.

The sheet guide means 90 further comprises a pair of clamping roller segments 97, which are mounted on a support rod 98 which is positioned along an axis parallel to the axis of the guide roller segments 92 so that the clamping roller segments rest upon the peripheral surface of respective ones the guide roller segments. The clamping roller segments are freely rotatable, and the rod is supported by means of a pair of lever arms 99 which are pivotally mounted on respective posts 70 of the roll 51, as best seen in FIG. 1, and so that the clamping roller segments rest from their own weight upon the guide roller segments 92.

To assist in properly delivering the sheets onto the conveyor belt B, at least one sheet guiding member 100 is positioned downstream of the nip and downstream of the sheet guiding means as seen in FIG. 1. The sheet guiding member is fixedly mounted above the conveyor belt, and it includes a downwardly inclined surface portion 102 for engaging the leading edge of each sheet and guiding the same towards an oscillating gripper 104 of conventional design. More particularly, the gripper is programmed to oscillate toward the clamping roller segments to engage the leading edge of each sheet, and then oscillate rearwardly while engaging the leading edge and so as to accurately position the sheet on the conveyor belt B.

A photocell 110 is mounted on the apparatus to control the operation thereof. More particularly, in one possible mode of operation, when no sheet is detected by the photocell, the motor is actuated so as to rotate the endless belts 30 and drive rollers 33 a controlled distance which is calculated to deliver a single sheet through the nip. Concurrently, the gripper 104 is oscillated toward the apparatus to catch the leading edge of the sheet, and then oscillate rearwardly to its release position. The advancing sheet is detected by the photocell 110, which holds the motor deactivated until the sheet is moved by the conveyor beyond the site of the photocell. The sequence is then repeated to deliver another sheet from the stack onto the conveyor belt.

Alternatively, the illustrated embodiment of the apparatus can be operated in a continuous fashion without the photocell or only using the photocell as a counter. In this mode, the speed of the drive means 42 and the conveyor belt B speed must be coordinated so that sheets fall on the belt at desired intervals.

During the sheet feeding operation, it is preferred that the gap formed at the nip 52 be adjusted such that the lowermost sheet of the stack is free to pass through the nip 52 without engaging the rings 62 and thus without significant frictional resistance, while the sheet immediately above the lowermost sheet engages the rings 62 of the roll 51 and is retarded by the increased frictional resistance provided by the rings. Thus the sheets above the lowermost sheet are held substantially stationary in the stack. Also, the rear support member 34 is positioned so as to lift the rear side of the stack from the upper run of the three endless belts 30 and rollers 33 such that the sheets in the stack above the lowermost sheet will only contact the upper run after the lowermost sheet has entered the nip. Thus the sheets are reliably fed in a serial manner from the bottom of the stack and until all of the sheets in the stack have been delivered onto the conveyor belt B.

The apparatus may also be operated to provide for the shingling of the sheets being fed. In this regard, it will be understood that the peripheral surface on the side of the roll 51 facing the stack is smooth so as to offer very little resistance as the sheets form around the surface and are guided to the nip 52. The nip is adjusted to allow the lowermost sheet to freely pass between the rings 62 and the lower drive belt 30 and rollers 33. The second sheet which is immediately above the lowermost sheet meets the resistance of the rings 62 at the nip and is held in place until the lower sheet has fed out enough to allow contact with the underlying drive belt system which then drives the second sheet forward into a tight fit in the nip. The trailing edge of the lowermost sheet passes the nip and the second sheet continues to drive forward, thus allowing shingling. This system makes this feeder very tolerant of open edge leading products and slick sheets.

For shingling, the distance of the rings 62 from the drive rollers 33 is preferably about one and one-half times the thickness of the paper being fed. The rings thus retard the overlying second sheet while having minimum contact with the underlying first sheet.

It will be apparent that the contact between the advancing sheets and the elastomeric rings 62 at the nip will in time cause the rings to wear and become less effective. One of the advantages of the present invention resides in the fact that the rings may be easily grasped at the channel 64 (FIG. 6) and rotated circumferentially, to position an unworn portion of each ring at the nip. Also, if necessary, the rings may be totally removed and replaced.

In the drawings and specification, there has been disclosed a preferred embodiment of the invention and, although specific terms are employed, they are used in a generic and descriptive sense only and not for purposes of limitation, the scope of the invention being set forth in the following claims.

That which is claimed is:

1. An apparatus for serially feeding sheets in a forward direction from the bottom of a generally vertical stack of such sheets comprising:

means for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt so that said upper run moves in the forward direction; and means including a stationary gate forming member positioned above said upper run of said belt means and adjacent the forward side of said stack and so as to define a nip which forms a gap between said gate forming member and said upper run, for permitting the lowermost sheet of the stack to pass forwardly from the stack through said nip, said gate forming member including first surface means facing toward said forward side of said stack so as to engage the forward edges of the sheets in the stack, and second surface means at said nip and having a coefficient of friction which is higher than that of said first surface means, and such that the lowermost sheet is free to pass through said nip without significant frictional resistance while the sheet immediately above the lowermost sheet is retarded in moving through said gap by its frictional engagement with said second surface means.

2. The apparatus as defined in claim 1 wherein said stack defines a rear side which is opposite said forward side, and said supporting means further includes a rear support member positioned above the upper run of said belt means and below the rear side of said stack, such that the rear support member lifts the rear side of said stack from the upper run of said belt means and the sheet in the stack above the lowermost sheet will only contact the upper run after the lowermost sheet has entered said nip.

3. The apparatus as defined in claim 2 further comprising means adjustably mounting said rear support member for adjustable movement in the direction of movement of said endless belt means and so as to permit the apparatus to accommodate sheets of different sizes.

4. The apparatus as defined in claim 3 further comprising means adjustably mounting said gate forming member so as to permit the dimension of said nip to be adjusted.

5. The apparatus as defined in claim 4 wherein said means adjustably mounting said gate forming member includes spring biasing means for biasing said member toward said nip and for permitting limited movement of said member away from said nip and against the force of said spring biasing means.

6. The apparatus as defined in claim 1 wherein said first surface means comprises a material having a coefficient of friction of about 0.15–0.35.

7. The apparatus as defined in claim 6 wherein said second surface means comprises a material having a coefficient of friction of about 0.5–0.7.

8. The apparatus as defined in claim 1 further comprising sensing means for sensing the presence or absence of a sheet exiting said nip.

9. The apparatus as defined in claim 8 wherein said sensing means communicates with said drive means so as to actuate said drive means when no sheet is sensed by said sensing means.

10. The apparatus as defined in claim 8 wherein said sensing means stops said drive means from operating upon having sensed a predetermined number of sheets passing through said nip.

11. The apparatus as defined in claim 8 wherein said sensing means comprises a photocell.

12. An apparatus for serially feeding sheets in a forward direction from the bottom of a generally vertical stack of such sheets and comprising:

means for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt so that said upper run moves in the forward direction;

a gate forming member positioned above said upper run of said belt means and adjacent the forward side of said stack and so as to define a nip which forms a gap between said gate forming member and said upper run for permitting the lowermost sheet of the stack to pass forwardly from the stack through said nip, said gate forming member comprising a generally cylindrical roll defining a central axis and an outer peripheral surface which is concentric to said central axis, said cylindrical roll being oriented so that a first half of said peripheral surface faces toward said forward side of said stack of sheets and a second half faces in the opposite direction, said roll having a plurality of annular grooves extending about the circumference thereof, with said grooves being disposed concentrically about a second axis which is parallel to and offset from said central axis in a direction parallel to said forward direction so that said grooves are relatively deep along said first half of the peripheral surface of said roll and relatively shallow along said second half of the peripheral surface, with a transition between said first and second halves being located adjacent said nip and adjacent a diametrically opposite location, said gate forming member further comprising a ring disposed in each of said grooves, with said rings being composed of a material having a higher coefficient of friction than the material of said roll and being sized so as to lie radially inside of said peripheral surface of said roll about said first half thereof and to extend radially beyond said peripheral surface about said second half thereof, and so that said rings extend slightly beyond said peripheral surface at said nip and are spaced from said endless belt means, and whereby the lowermost sheet is free to pass through said nip without significant engagement with said rings and thus without significant frictional resistance while the sheet immediately above the lowermost sheet engages said rings and is frictionally engaged thereby.

13. The apparatus as defined in claim 12 further comprising sheet guide means positioned downstream of and in registry with said nip for guiding the sheets forwardly after advancing through said nip.

14. The apparatus as defined in claim 13 wherein said sheet guide means comprises a guide roller mounted for rotation about a fixed axis disposed parallel to said axes of said support shafts, with the upper portion of said guide roller being substantially coplanar with said upper run of said belt means and transmission means operatively connected between said drive means and said guide roller for rotating said guide roller at a peripheral speed corresponding to the speed of said endless belt means.

15. The apparatus as defined in claim 14 wherein said transmission means comprises a plurality of guide belts and rollers entrained about said one support roll and said guide roll, with said guide belts having an upper run which is substantially coplanar with said upper run of said endless belt means.

16. The apparatus as defined in claim 15 wherein said sheet guide means further comprises a clamping roller, and means mounting said clamping roller for free rotation about an axis parallel to the axis of said guide roller and so that said clamping roller rests upon the peripheral surface of said guide roller.

17. The apparatus as defined in claim 13 further including a sheet guiding member positioned downstream from said sheet guide means and said nip, said sheet guiding member having a downwardly inclined surface portion for engaging the leading edge of each delivered sheet and guiding the same a predetermined area.

18. The apparatus as defined in claim 12 further comprising sensing means for sensing the presence or absence of a sheet exiting said nip.

19. The apparatus as defined in claim 18 further comprising means operatively interconnecting said sensing means with said drive means so as to actuate said drive means when no sheet is sensed by said sensing means.

20. The apparatus as defined in claim 18 wherein said sensing means stops said drive means from operating upon having sensed a predetermined number of sheets passing through said nip.

21. The apparatus as defined in claim 18 wherein said sensing means comprises a photocell.

22. The apparatus as defined in claim 12 wherein said means rotatably mounting said endless belt means includes a pair of spaced apart support shafts mounted for rotation about parallel axes and having said endless belt means entrained thereabout.

23. The apparatus as defined in claim 22 wherein said endless belt means comprises a plurality of endless belts, and a pair of aligned support rolls mounted on respective ones of said support shafts and mounting each of said endless belts, and a plurality of drive rolls mounted on each of said support shafts, with at least one of said drive rolls being positioned between adjacent endless belts, and with the diameter of said support rolls being less than the diameter of said drive rolls so that said drive rolls have an outer surface which is substantially coextensive with the outer surface of said endless belts.

24. The apparatus as defined in claim 23 wherein one of said support shafts is aligned with said cylindrical roll of said gate forming member so that the drive rolls on said one support shaft are aligned across the nip from said cylindrical roll.

25. The apparatus as defined in claim 12 wherein said cylindrical roll of said gate forming member includes an axially extending channel in said second half of said peripheral surface to facilitate engagement of said rings and removal or rotational adjustment thereof.

26. The apparatus as defined in claim 12 further comprising means adjustably mounting said gate forming member so as to permit the dimension of said nip to be adjusted and such that said gate forming member may be readily removed from the remainder of said apparatus.

27. A gate forming member for use with an apparatus for serially feeding sheets in a forward direction from the bottom of a generally vertical stack of such sheets and comprising:

a generally cylindrical roll defining a central axis and an outer peripheral surface which is concentric to said central axis, said roll having a plurality of annular grooves extending about the circumference thereof, with said grooves being disposed about a second axis which is parallel to and offset from said central axis and so that each groove is relatively deep along a first half of the peripheral surface of said roll and relatively shallow along a second half of the peripheral surface, and a ring disposed in each of said grooves, with said rings being composed of a material having a higher coefficient of friction than the material of said roll and being sized so as to lie radially inside of said peripheral surface of said roll about said first half thereof and to extend radially beyond said peripheral surface about said second half thereof.

28. The gate forming member as defined in claim 27 wherein said roll includes an axially extending channel extending along said second half of said peripheral surface to facilitate engagement of said rings and removal or rotational adjustment thereof.

29. The gate forming member as defined in claim 28 wherein said roll includes a threaded radial opening at a central position along its axial length, for facilitating the mounting of said roll.

30. The gate forming member as defined in claim 29 wherein said roll further includes mounting parts extending from opposite ends of said roll and with said mounting posts being coaxially aligned with said central axis.

* * * * *